US005214820A

United States Patent [19]

Shumway et al.

[11] Patent Number: 5,214,820

[45] Date of Patent: Jun. 1, 1993

[54] DISH SCRUBBER

[76] Inventors: Craig S. Shumway; Amy Shumway, both of 865 S. Pennsylvania Ave., Winter Park, Fla. 32789

[21] Appl. No.: 878,568

[22] Filed: May 5, 1992

[51] Int. Cl.[5] ..... A47L 13/12

[52] U.S. Cl. ..... 15/118; 15/211; 15/244.1; 51/392; 51/395; 51/401

[58] Field of Search ..... 15/118, 210 R, 210.5, 15/211, 223, 224, 244.1, 244.3, 230.16, 209.1, 229.11, 229.13; 51/391, 392, 395, 401, 407

[56] References Cited

U.S. PATENT DOCUMENTS

| | | | |
|---|---|---|---|
| 1,804,240 | 5/1931 | Welsh | 15/118 |
| 2,941,225 | 6/1960 | Paul | 15/244.1 |
| 3,317,944 | 5/1967 | Napier, Sr. et al. | 15/244.1 |
| 3,646,628 | 3/1972 | Halford | 15/118 |
| 4,055,897 | 11/1977 | Brix | 51/401 |
| 4,190,921 | 3/1980 | Rose | 15/209 B |
| 4,856,136 | 8/1989 | Janssen | 15/210 R |

FOREIGN PATENT DOCUMENTS

| | | | |
|---|---|---|---|
| 1115137 | 4/1956 | France | 15/244.1 |
| 1188381 | 4/1970 | United Kingdom | 51/401 |

*Primary Examiner*—Harvey C. Hornsby
*Assistant Examiner*—Mark Spisich
*Attorney, Agent, or Firm*—Warren L. Franz

[57] ABSTRACT

A dish scrubber has an elongated handle and a cylindrical scrubbing element attached at one end to the handle. The scrubbing element is of laminar configuration having a leading layer of scouring material glued to an underlying layer of foam. The element is longitudinally grooved to provide circumferentially spaced teeth with cutting edges. The scrubber is configured so that the scouring layer contacts the bottom and the cutting edges contact the sides to clean the interior cavity of a coffee mug or similar cylindrical dishware cavity.

12 Claims, 1 Drawing Sheet

DISH SCRUBBER

This invention relates to a dish scrubber; and, in particular, to a handled dish scrubber having a laminated foam/scouring material cylindrical scrubbing element.

BACKGROUND OF THE INVENTION

Handled dish scrubbers are useful for cleaning the interiors of glasses, bottles, coffee mugs, and the like. Typical scrubbers of this type comprise plastic or wire-form handles having openings through which strips of foam are brought to project radially outward from a central point of attachment. When wet, the strips do not present a uniform cross-section, lack backup support, and do not provide an abrasive surface or a good cleaning edge. In short, they lack the rigidity, shape and composition needed to quickly and efficiently clean the walls and bottoms of cylindrical dishware cavities.

Laminate foam/scouring material scrubbing elements are known in the form of rectangular scrubbing pads. These are sometimes provided with angled handles extending generally in line with the plane of the scrubber, so cannot readily be used to scour the bottom of a dishware cavity.

SUMMARY OF THE INVENTION

The present invention provides a handled dish scrubber having a cylindrical foam/scouring material laminar scrubbing element, provided with a plurality of cutting edges circumferentially spaced about a solid core.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENTS

The principles of the invention will be understood by reference to an exemplary implementation thereof shown in FIGS. 1–4.

Figure 1:
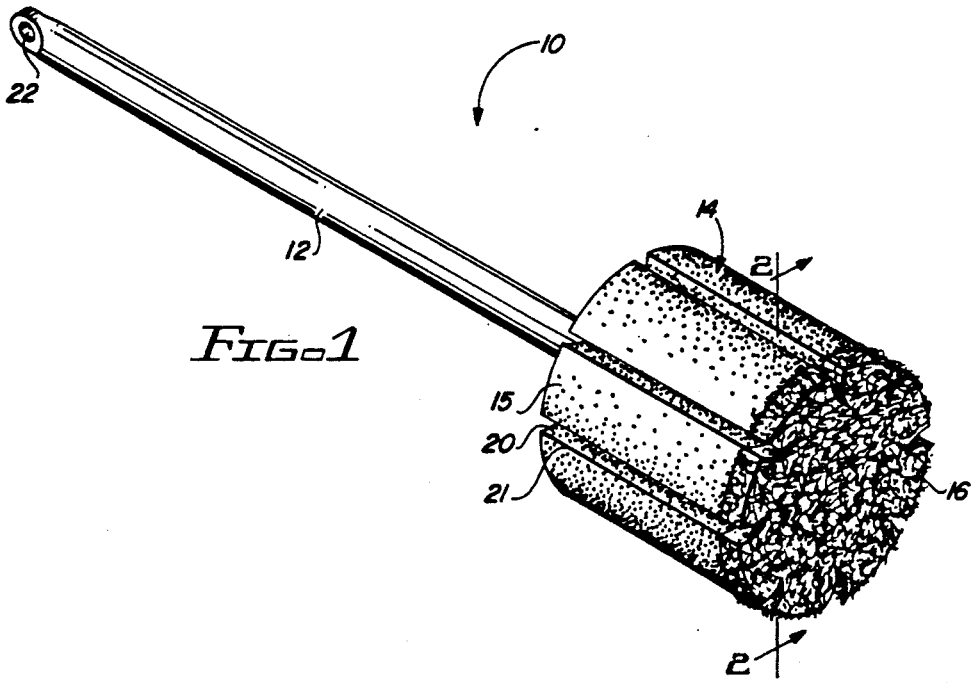
FIG. 1 is a perspective view of an embodiment of dish scrubber in accordance with the invention.
Figure 2:
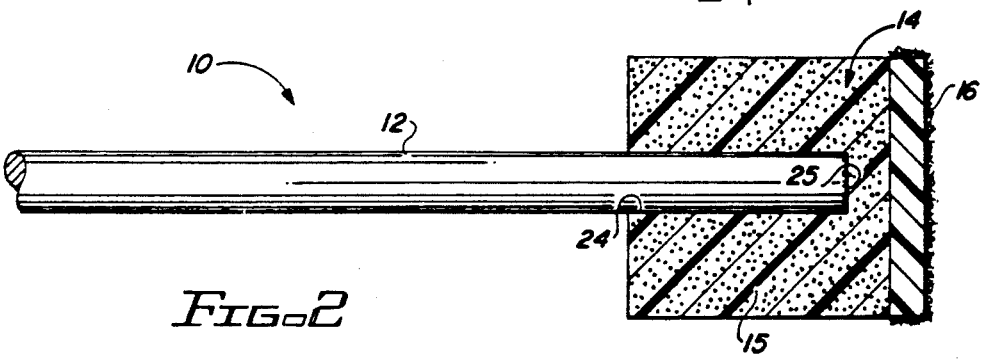
FIG. 2 is a section view taken along the line 2—2 in FIG. 1.
Figure 3:
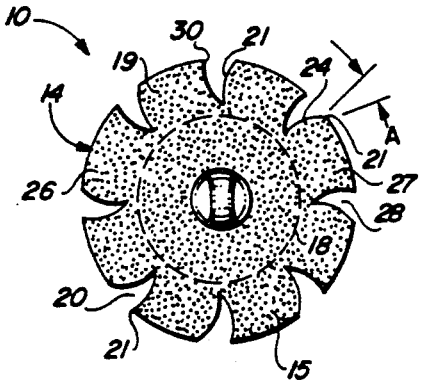
FIG. 3 is a handle end view of the scrubber of FIG. 1.

As shown in FIGS. 1–3, a dish scrubber 10, suitable for cleaning the interior cavities of glasses, bottles, coffee mugs, and the like, comprises a handle 12, elongated in a longitudinal direction and a cylindrical scrubbing element 14 coaxially mounted at one end of the handle 12. The element 14 is of laminate construction having a cylindrical inner layer of foam material 15 and a cylindrical outer layer of scouring material 16 superposed in matching coaxial relationship over the outer circular end face of layer 15, in a position longitudinally outward of the inner layer relative to the other end of the handle.

The laminar element 14 has a solid central core region 18 (shown in dot-dashed lines in FIG. 3), and an annular region 19 surrounding the core region 18. The annular region 19 includes a plurality of grooves 20, further described below, which extend in the longitudinal direction and define a corresponding plurality of longitudinally extending cutting edges 21, circumferentially spaced at approximately equiangular positions about the solid core region 18.

A preferred material for the foam layer 15 is an open, double cell 42 lb. weight polyurethane foam. A preferred material for the scouring layer 16 is nylon mesh material that does not scratch Teflon TM or other cookware finishes. Antibacterial substances can be used for baby bottle and similar antiseptic environments. The composite structure 14 can be formed by applying a layer of scouring material over an uncut sheet of foam. A $\frac{1}{8}''$–$\frac{1}{4}''$ thickness of scouring material over a 3" thickness of foam has been found sufficient. The two layers are bonded together at the interface using a known heat resistant, waterproof adhesive. A multiplicity of the two cylindrical configurations 14 can then be cut from the laminate sheet in a single die cutting step.

The handle 12 can be of wood dowel or other known scrubber handle construction, including a transverse bore 22 (FIG. 1) at the non-scrubbing, hand-grippable end. The bore 22 is useful for hanging and other purposes, as with conventional scrubbers. The scrubber end of handle 12 is glued within a coaxial, blind end bore 24, opening coaxially onto the handle end face of the foam layer 15. The captured end 25 of handle 12 is set back from the scour end of element 14 by an interval (suitably $\frac{1}{2}''$ for a $\frac{1}{2}''$ dowel glued in a 3" element 14 length), so that the handle 12 substantially supports the element 14 without poking through the scrubber end during normal usage.

The illustrated embodiment (see FIG. 3), has eight radially-extending teeth 26, evenly-spaced circumferentially about the solid core 19. Each tooth 26 comprises a land 27, separated from the-land 27 of the next tooth 26 by a flute 28 established by the corresponding groove 20. The radial rake of the cutting edge 21 is suitably provided with a positive rake angle A, as shown. The tooth face 29 is made slightly convex, rather than flat, to better hold its shape while nevertheless providing a keen cutting edge 21. The land width behind the cutting edge is left unrelieved to maintain the uniform cylindrical cross-section of the scrubbing element 14. The arcuate distance (heel 30 to cutting edge 21) of the grooves 20 is suitably made approximately one-third the arcuate distance (cutting edge 21 to heel 30) of the teeth 26. The diameter of the uncut core region 18 is suitably made approximately two-thirds the diameter of the total cylinder 14. It will be understood, of course, that the number and configuration of teeth 26 can be varied in accordance with individual requirements and preferences. Moreover, though the flutes 28 (i.e., grooves 20) are shown parallel to the cylindrical axis for ease of die cutting during manufacture, helical or other longitudinally extending shapes are also workable.

Figure 4:
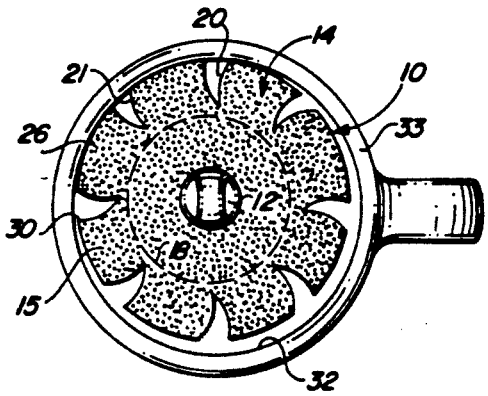
FIG. 4 is a view, similar to that of FIG. 3, useful in understanding the operation of the invention.

In operation, the scrubbing end 14 of the scrubber 10 is inserted into the interior cavity 32 of an item of dishware, such as the cylindrical hollow of a coffee mug 33 as shown in FIG. 4, and rotated. The scouring layer 16 on the leading face of the scrubbing element 14 contacts and provides scouring action to the bottom of the mug 33. The circumferentially located cutting edges 21 and heels 30 of the teeth 26 contact the internal cylindrical walls of the cavity 32 to provide sponge contact cleansing action. The outside diameter of element 14 may be chosen to match a particular dishware item, so as to provide a close contacting fit with the sides of the cavity to be cleansed. For example, a 3" diameter element 14 may be advantageously applied for mugs, and a 2¼" diameter element 14 may be applied for glassware. Cleansing contact is assured by slightly overdimensioning the diameter of element 14 relative to the diameter of the intended cavity. As shown in FIG. 4, when the scrubber handle is rotated, the teeth will uniformly collapse into the grooves 20 to reduce the diameter of the scrubber 14 to match the cavity 32, without distorting the solidity and stability of the core 18.

Those skilled in the art to which the invention relates will appreciate that other substitutions and modifications can be made to the described embodiment without departing from the spirit and scope of the invention as described by the claims below.

What is claimed is:

1. A handled dish scrubber suitable for cleaning dishware internal cavities, comprising:

a handle elongated in a longitudinal direction and having opposite ends; and a cylindrical scrubbing element coaxially mounted at one end of the handle;

the scrubbing element being of laminate construction including a cylindrical inner layer of foam material and a cylindrical outer layer of scouring material superposed in matching coaxial relationship over the inner layer, in a position longitudinally outward of the inner layer relative to the other end of the handle; and the scrubbing element further having a solid central core region and an annular region circumferentially surrounding the core region; the annular region having a plurality of grooves extending in the longitudinal direction and defining a corresponding plurality of longitudinally extending cutting edges circumferentially spaced about the core region.

2. A handled dish scrubber as in claim 1, wherein the cutting edges are circumferentially spaced at equiangular positions about the core region.

3. A handled dish scrubber as in claim 2, wherein the foam material comprises a double cell polyurethane foam material, and the scouring material comprises a non-scratching nylon mesh material.

4. A handled dish scrubber as in claim 3, wherein the layer of foam material is at least 10 times thicker than the layer of scouring material.

5. A handled dish scrubber as in claim 4, wherein the diameter of the core region is a majority of the diameter of the scrubbing element.

6. A handled dish scrubber as in claim 5, wherein the grooves define flutes that separate lands between flutes of the annular region into teeth having radially directed tooth faces presenting the cutting edges.

7. A handled dish scrubber as in claim 6, wherein the cutting edges are parallel to a longitudinal axis of the scrubbing element.

8. A handled dish scrubber a in claim 7, wherein the cutting edges are provided with positive radial rake angles.

9. A handled dish scrubber as in claim 8, wherein the tooth faces are made slightly convex.

10. A handled dish scrubber as in claim 9, wherein the widths of the lands behind the cutting edges are left unrelieved.

11. A handled dish scrubber as in claim 10, wherein the arcuate distance of the grooves at the scrubbing element outside diameter is one-third the arcuate distance of the teeth.

12. A handled dish scrubber suitable for cleaning dishware internal cavities, comprising:

a handle elongated in a longitudinal direction and having opposite ends; and a cylindrical scrubbing element coaxially mounted at one end of the handle;

the scrubbing element being of laminate construction, including a cylindrical inner layer of foam material and a cylindrical outer layer of scouring material superposed in matching coaxial relationship over the inner layer, in a position longitudinally outward of the inner layer relative to the other end of the handle; the inner layer having a thickness substantially greater than a corresponding thickness of the outer layer; and the scrubbing element further having a uniform cross-section, with a solid core region and an annular region circumferentially surrounding the core region; the annular region having a plurality of grooves extending in the longitudinal direction and defining a corresponding plurality of longitudinally extending cutting edges circumferentially spaced at equiangular positions about the core region; and the core region having a diameter which is at least one-half the diameter of the scrubbing element.

* * * * *